US005143132A

United States Patent [19]

Keller

[11] Patent Number: 5,143,132

[45] Date of Patent: Sep. 1, 1992

[54] SYSTEM FOR MAKING DOVETAIL JOINTS INCLUDING ACUTE AND OBTUSE ANGLE DOVETAILS AND BOX JOINTS

[76] Inventor: David A. Keller, 1327 I St., Petaluma, Calif. 94952

[21] Appl. No.: 571,055

[22] Filed: Aug. 21, 1990

[51] Int. Cl.[5] ..... B27M 3/00

[52] U.S. Cl. ..... 144/372; 144/87; 144/144 R; 144/144.5 R

[58] Field of Search ..... 144/87, 144 R, 144.5, 144/371, 372, 85

[56] References Cited

U.S. PATENT DOCUMENTS

| | | | |
|---|---|---|---|
| 2,764,191 | 9/1956 | Hartmann | 144/87 |
| 4,373,562 | 2/1983 | Vernon | 144/144.5 |
| 4,542,776 | 9/1985 | Kehoe | 144/87 |
| 4,809,755 | 3/1989 | Pontikas | 144/87 |

*Primary Examiner*—W. Donald Bray
*Attorney, Agent, or Firm*—Skjerven, Morrill, MacPherson, Franklin & Friel

[57] ABSTRACT

According to the present invention, a method is provided for making joints having angles other than right angles. Also, according to the invention, thickness of wood to be cut and/or size of the router bits used with a particular setup of template and fence can be changed simply by use of shims, without need for readjusting the fence or screws connecting the templates to their corresponding fences. This adjustability now includes, as a novel feature, the ability to cut dovetail joints using pin boards in stock thicker than the length of a dovetail bit without having to use a fence in which a rabbeted shim is substituted for a straight shim. Additionally, a method of cutting box joints using a combination of a dovetail template and a pin router bit has been found.

13 Claims, 15 Drawing Sheets

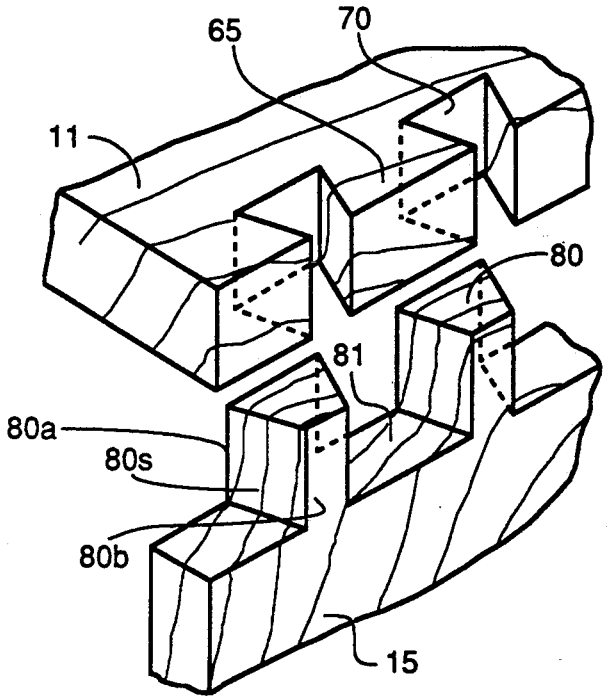
FIG. 1a
(PRIOR ART)
FIG. 1b
(PRIOR ART)
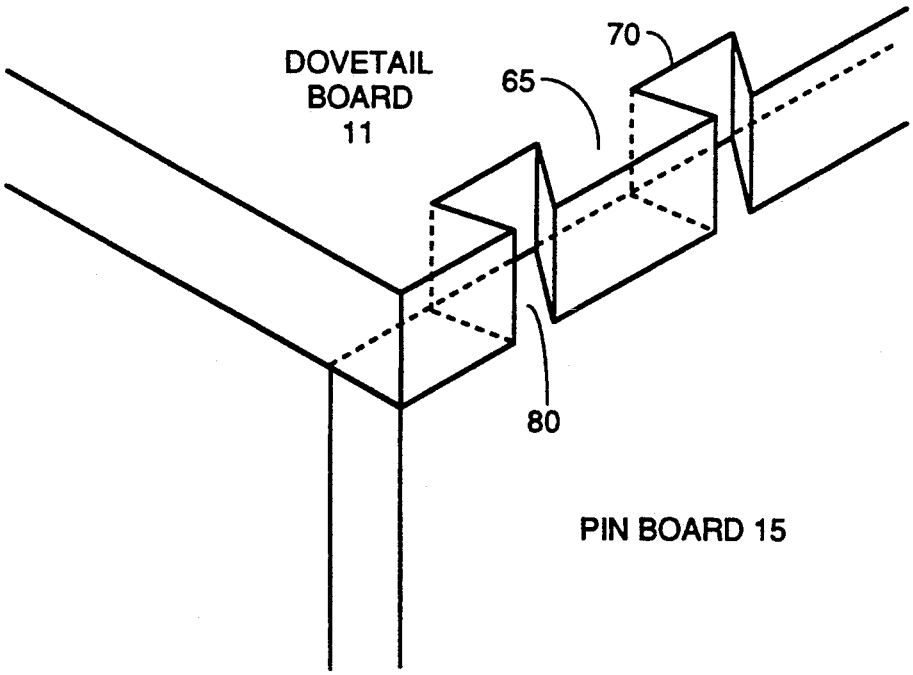

SYSTEM FOR MAKING DOVETAIL JOINTS INCLUDING ACUTE AND OBTUSE ANGLE DOVETAILS AND BOX JOINTS

FIELD OF THE INVENTION

The present invention relates to apparatus and method for forming dovetail joints, more particularly to a combination of templates and bits useful for variable material thickness and variable angles.

BACKGROUND

Dovetail joints between perpendicular wooden members are well known. Forming a dovetail joint requires cutting a dovetail board and a pin board. As shown in FIG. 1*a*, dovetail board 11 includes dovetail sockets 70 separating dovetails 65. A dovetail is distinguished in that it is wider at its free end than at its interior end. As shown in FIG. 1*a*, all surfaces of dovetail sockets 70 extend perpendicular to the major surfaces of dovetail board 11. Pin board 15 includes wedge-shaped pins 80 extending from an end of pin board 15. Side surfaces 80*s* of pins 80 extend perpendicular to a base 81. Pin exterior sides 80*b* are narrower than pin interior sides 80*a*. Pins 80 are sized, shaped, and positioned to mate with dovetail sockets 70 when pins 80 are inserted into sockets 70. The wedge shape of pins 80 combined with the wider free ends of dovetails 65 prevents pins 80 from being extracted from dovetail board 11 except in a direction parallel to a major surface of pin board 15. The serpentine nature of dovetail joints also provides a large gluing surface. These characteristics make dovetail joints desirable for fine furniture and other application where durability and tight fit are desired.

Apparatus and a method for forming dovetail joints using templates and a router are described in U.S. Pat. No. 4,168,730. This patent was obtained Sep. 25, 1979 by the present inventor, and is incorporated herein by reference. This patent discloses forming dovetail joints using a router with templates and corresponding router bits which allow a user to form dovetail joints extremely accurately with minimum setup time. The tool set reduces the tendency for the router to tip relative to the template and/or work, and can be used by both amateur carpenters and precision woodworking craftsmen.

As shown in FIG. 2*a*, according to U.S. Pat. 4,168,730, two templates, dovetail template 12 and pin template 14 are provided. As shown in FIG. 2*b*, template 12 is attached by a screws 71 to a fence 66 against which a board 64 is placed and held for cutting. The board 64 may be held as shown by clamp 68, or by other clamping means such as toggle, cam, or air actuated clamps, clamping bars or cauls, or machine screws or bolts. Dovetail bit 16, turned by a router, not shown, is guided by bearing 36 against surfaces 24 of template 12 to make dovetail shaped socket cuts in dovetail board 64. Likewise, as shown in FIG. 2*c*, pin template 14 is attached to a fence 76, and a pin board 72 is clamped to fence 76 for cutting of pins using pin bit 18. Guide bearings 36 and 56 located at the neck of dovetail and pin bits 16 and 18 respectively, guide the router along the respective template.

U.S. Pat. 4,168,730 also shows a method for making dovetail joints using a pin board thicker than the length of the dovetail bit. As shown in FIG. 2*d*, in addition to removing waste from between the pins, a portion greater than the maximum thickness which the dovetail bit can reach is rabbeted away from the interior surface of the pin board. As shown in FIG. 2*e*, a correspondingly rabbeted fence 96 is used with fence 94 and pin template 14 such that pin board 90 can be supported against the rabbeted fence 96 while the pin cuts are being made. As shown in FIG. 2*f*, the width E of the rabbeted cut is made equal to the thickness of the dovetail stock.

Since U.S. Pat. No. 4,168,730 was applied for, further variations in the apparatus and method have been made. The "Owner's Manual", Keller Dovetail Templates, available from Keller & Co., 1327 I Street, Petaluma, CA 94952, copyright 1989, describes certain of these Variations. As shown in FIGS. 3*a*–3*d*, a set of dovetail and pin templates and router bits is provided, as before. However, pin template 314 includes open ends 342. Open ends 342 extend between guide surfaces such as 342*a* and 342*b* which are for shaping two sides of the same pin. With the ends open, it is possible to move a router so that bit 18 passes away from one slot in the pin board and into the next slot without the need for lifting the router away from the upper surface of pin template 314.

Additionally, as shown in FIGS. 4*a*–4*c*, scribed lines 418 and 419 are provided on lower surfaces of both templates 412 and 414 to assist the user in attaching fences 466 and 476 respectively. In the case of the dovetail template 412, there must be a distance B between a back surface 444 of each socket guide 443 and the working surface 468 of fence 466 for the center of the dovetail bit (not shown in FIG. 4*a*) to pass beyond the edge of the dovetail board This way the dovetail bit can cut the dovetail board clean through. If the distance B is somewhat larger than necessary, there is no change in the fit of the finished cuts, thus the position of template 412 against fence 466 is not critical. It is generally important, however, that template 412 be mounted to fence 466 such that edge 468 is perpendicular to openings 443. Aligning the fence 466 with scribe line 418 assures this perpendicularity, and further assures that fence 466 is parallel to the long edge of template 412.

In the case of pin template 414, as shown in FIG. 4*b*, it is essential for proper joint fit that fence 476 be properly positioned along pin template 414 such that distance C, which is the distance between the intersection 477*a* of one opening 473 with fence edge 478 and the intersection 477*b* of the next opening 474 with fence edge 478, be essentially the same as the diameter of the lower edge of the largest dovetail bit to be used. If the distance C is too small, the pins 80 which remain after waste is removed from pin board 15 will be too small, and the joint will be too loose. Conversely, if the distance C is too large, the joint will be too tight. In order to allow for fine adjustment, for example during initial setup of the template, or when the bit must be sharpened and becomes slightly smaller, screw holes 421 are formed as elongated slots so that the position of template 414 against fence 476 can be finely adjusted.

SUMMARY OF THE INVENTION

According to the present invention, a method is provided for making joints having angles other than right angles using the same combination of templates and bits described above. Also, according to the invention, thickness of wood to be cut with a particular setup of template and fence can be changed without need for readjusting the position of the template on the fence and thus adjusting the screws connecting the templates to their corresponding fences. This adjustability now includes, as a novel feature, the ability to cut dovetail joints using pin boards in stock thicker than the length of a dovetail bit without having to use a fence in which a rabbeted shim is substituted for a straight shim. Additionally, a method of cutting box joints using a combination of a dovetail template and a pin or straight router bit has been found.

Also, with the present invention, both the length and the diameter of router bits to be used with a particular setup of template and fence can be changed, and properly fitting joints can be achieved with a simple adjustment to the fence. This means the user can change the size of the dovetail sockets and pins easily while still using the same templates.

When joints having acute or obtuse angles are to be formed, only the dovetail board, and not the pin board, is cut at a corresponding angle. For an obtuse angle, a wedge having an acute angle equal to the number of degrees over 90 desired in the final joint is attached to the fence. Alternatively, a new fence can be cut having a face at the desired angle, and substituted for the original fence. (Additional alternatives will become clear from the detailed description below.) At this point the inside and/or outside corners of the dovetail board can be cut away at an angle to match the wedge. Then the dovetail board to be attached at an obtuse angle is placed and held against the wedge, with a cut surface against the fence. When the dovetail cuts are made, they extend through the end of the dovetail board at an angle corresponding to that of the wedge. Alternatively, the inside and outside corners of the dovetail board can be cut away at an angle corresponding to the wedge angle, and the board clamped to a regular fence (perpendicular to the template) without a wedge. In this case, the inside corner cut will establish the angle of the assembled joint. When the pin board is inserted into this obtusely cut dovetail board, the desired obtuse angle results. Excess material at ends of the pins may be removed before or after assembly.

For an acute angle, an angular cut may be made at the end surface of the dovetail board. The dovetail board is placed against the wedge or the wedge shaped fence, with the outside face of the assembled joint against the wedge or wedge shaped fence. The dovetail socket cuts are made. Before the dovetail and pin boards are assembled, to allow the two boards to fit and seat against each other at all proper contact surfaces, an additional cut must be made on the interior surface of the dovetail board. As described more completely below, this cut extends from the inside corner of the dovetail board only to the bottom of the dovetail cut. This interior relief cut may be made before the dovetail sockets are cut, though such an order of steps is preferred only for production runs. The pin board is cut as described for a right angle joint. The pin board is then inserted into the dovetail board and attached at the desired acute angle. Excess material at ends of the pins and dovetails is removed before or after assembly.

For using wood of different thicknesses and bits of different sizes, no change is needed in the attachment of the dovetail template to the dovetail fence. The dovetail bit may be either a larger bit for use with thicker wood or a smaller bit having a length at least as great as the wood thickness. Dovetail bits of different diameters and lengths can be used in the same thickness of wood to produce variations in the dovetail pattern visible in the finished product, and to achieve maximum joint strength for different materials and material thicknesses. No change in the position of the dovetail fence with respect to the template is needed for cutting dovetails in thinner stock or for changing the diameter or length of the dovetail bit. For the pin template, the pin fence is installed such that the pin produced will match the size of the socket cut by the largest diameter dovetail bit. For stock thicker than the maximum dovetail bit length, rabbet cuts are made in both the thick pin board stock and in the fence of the pin template. The rabbet cut in the pin board stock is of sufficient depth to bring the thickness down to no more than the maximum dovetail bit length. The cut is made in the interior surface of the pin board along the edge where the dovetail joint will be made. The rabbet cut in the pin fence is of a depth to accommodate the corresponding rabbet cut in the thickest pin stock to be handled. For stock thinner than this maximum, a set of shims can be prepared of thicknesses appropriate to extend the surface of the rabbeted portion of the fence to match the thickness of the rabbet cut in the pin board.

For making dovetail cuts in wood thinner than the length of the pin bit, there is no need to adjust the dovetail bit or the dovetail template position with respect to the dovetail fence. Also, a dovetail bit of smaller diameter (and shorter) than was originally used may be substituted, with no change in the dovetail template and fence setup. For thinner dovetail stock, the pin bit is set to cut less deep. For a smaller dovetail bit, the fence of the pin template is modified by adding a shim to the face of the pin fence. This shim reduces the size of the cut pins so as to match the size of the smaller dovetail sockets.

For making dovetail joints in which the dovetail bit is larger than was originally used to set up the templates, again the dovetail sockets are cut as was done for the original dovetail bits. However, the pin template is moved forward with respect to the fence (in other words the fence is moved in a direction away from the work), thereby allowing the pin bit to produce larger pins in the pin board. The wood is then clamped against the shim and the cut made. For using this setting when it is desired to accommodate the smaller original dovetail bit, a shim is added to the face of the pin template fence. The stock is then clamped against the shim and the cut made.

Pin bits of various sizes will make cuts the same size and at the same place in the pin board. Thus it is not necessary to change the pin template fence in response to changing the size of the pin bit.

BRIEF DESCRIPTION OF THE DRAWINGS

FIGS. 1*a* and 1*b* show a prior art dovetail joint, in exploded and assembled arrangements respectively.

DETAILED DESCRIPTION

Figure 5A:
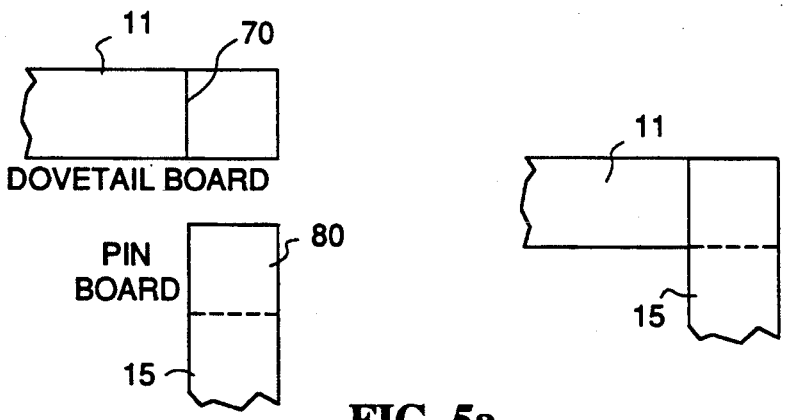
FIG. 5a (PRIOR ART)
FIGS. 5*a* is prior art.
Figure 5B:
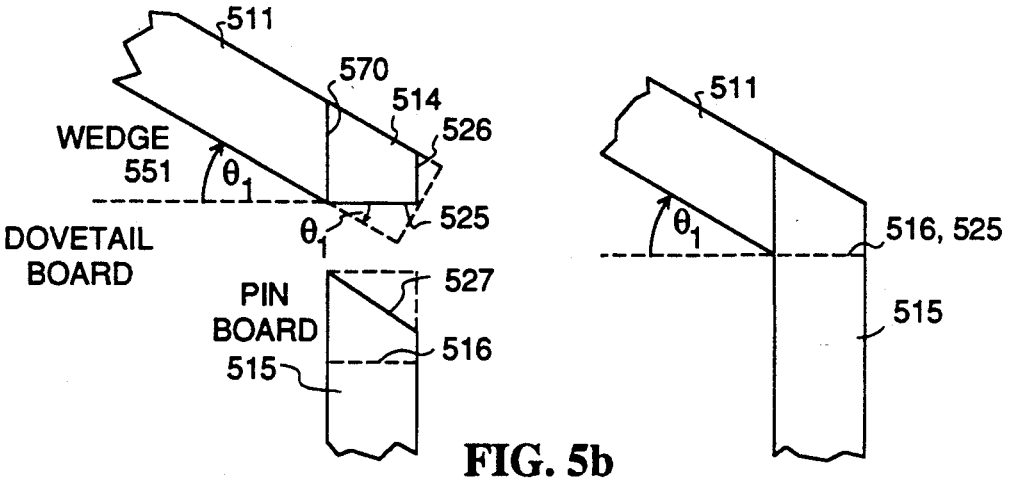
FIGS. 5*b* through 5*c* show dovetail joints made according to the method of the present invention for providing obtuse and acute angle joints as well as right angle joints.
Figure 5C:
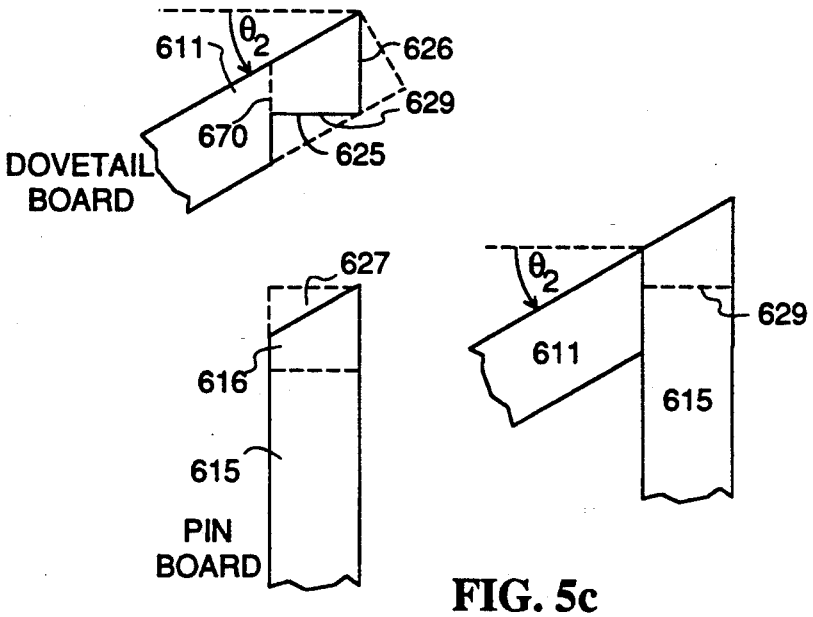

As shown in FIGS. 5*a* through 5*c*, according to the present invention, not only can right angle dovetail joints be prepared, as shown in prior art FIG. 5*a*, but obtuse angle joints can be prepared as shown in FIG. 5*b* and acute angle joints can be prepared, as shown in FIG. 5*c*.

Numbers shown in FIG. 5*a* are the same numbers as were shown in a perspective view of FIG. 1*a*. Corresponding components are given the same reference numerals Both exploded and assembled views are shown in FIG. 5*a*. Similarly, in FIG. 5*b* both exploded and assembled views of an obtuse angle joint are shown. As shown in FIG. 5*b*, dovetail board 511 is cut at surfaces 525 and 526 to remove original stock, thereby generating a new 90° corner which will fit against a cut surface of pin board 515. These cuts may be made before or after cutting the dovetail sockets. Surface 570 of dovetail board 511 is equivalent to surface 70 of dovetail board 11 shown in FIG. 1*a*. After being cut, as shown in FIG. 5*b*, dovetail board 511 can be fitted against pin board 515 such that surface 525 comes adjacent to surface 516 of pin board 515. As mentioned earlier, no change is needed in the method of cutting pin board 515 from that described in U.S. Pat. No. 4,168,730 for cutting pins in pin board 15. However, as shown in FIG. 5*b*, in order to achieve a smooth exterior surface to the finished joint, surface 527 may be cut at an angle $\theta_1$ either before or after assembly of dovetail board 511 and pin board 515.

Figure 5D:
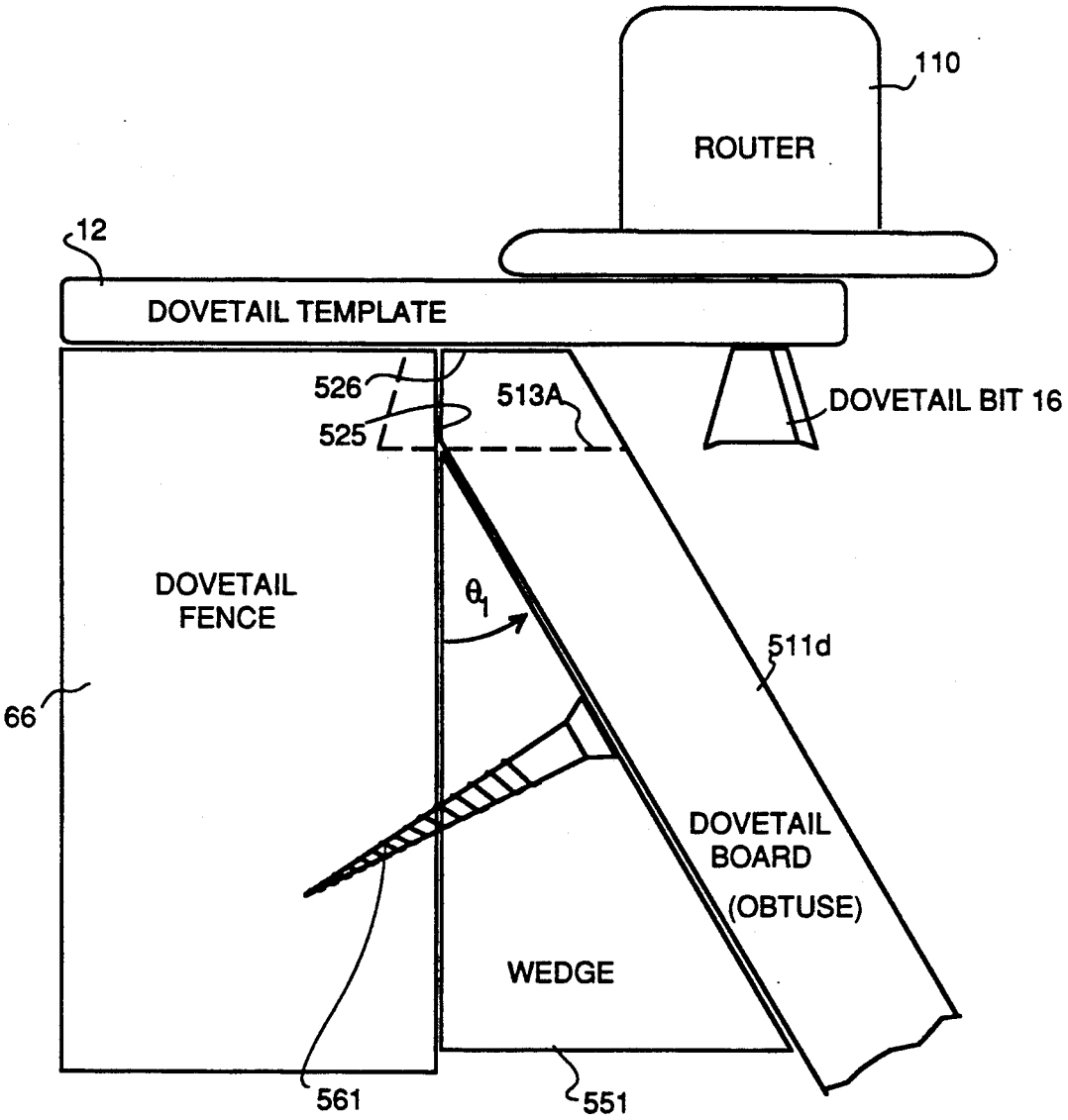
FIGS. 5*d*–5*f* show setups for cutting a dovetail board to receive a pin board at an obtuse angle.

As can be seen in FIG. 5*d*, surface 525 of dovetail board 511*d* is cut at an angle $\theta_1$ corresponding to the angle of wedge 551. Angle $\theta_1$ is the amount greater than 90° desired for the resulting obtuse angle. The length of surface 525 is selected to be equal to the thickness of pin board 515. Surface 526 is cut at 90° to surface 525 starting from the newly formed corner generated by cutting surface 525.

For cutting dovetail board 511*d*, wedge 551 is attached to dovetail fence 66 by screw 561. Wedge 551 can be secured to fence 66 by any appropriate means. Alternatively, rather than attach a wedge such as wedge 551 to fence 66, a new wedge-shaped fence shaped like the combination of wedge 551 and fence 66 can be attached to dovetail template 12.

FIG. 5*d* shows wedge 551 placed with its apex at a distance from the lower surface of dovetail template 12 equal to distance 525. In this embodiment, when dovetail board 511*d* is then placed against wedge 551 and template 12, surface 525 fits nicely against the exposed surface of dovetail fence 66, and surface 526 fits against dovetail template 12. This distance 525, as can be seen in FIG. 5*d*, is also equal to the effective length of dovetail bit 16. When dovetail bit 16 is moved by router 110 through dovetail board 511*d*, cuts are made, as guided by dovetail template 12 at an angle from perpendicular determined by wedge 551. Thus when dovetail board 511*d* is prepared, a standard pin board 515 can be inserted into dovetail board 511*d*.

Figure 5E:
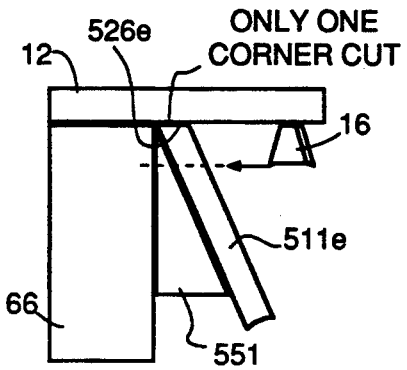
Figure 5F:
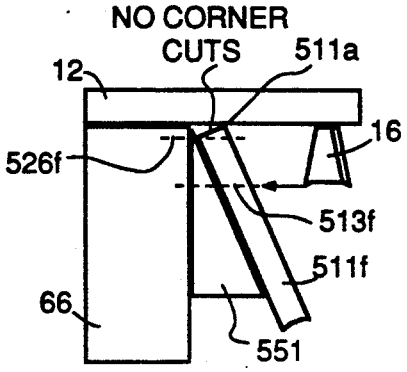

Alternatively, as shown in FIGS. 5*e* and 5*f*, it is possible to avoid making one or both cuts 525 and 526 before cutting the dovetail sockets. In these embodiments, wedge 551 is placed against fence 66 such that its apex contacts dovetail template 12. In the embodiment of FIG. 5*e*, only one cut is made along the end of dovetail board 511*e* to make surface 526*e*, which fits flush against dovetail template 12, and which will form an exposed surface in the final assembly. In the embodiment of FIG. 5*f*, the end of dovetail board 511 is left with its original shape, and a corner 511*a* of this end placed against dovetail template 12 for cutting. In order to provide sufficient depth of cut, dovetail bit 16 is moved downward so that inserting a pin board against floor 513*f* leaves excess material to be removed after assembly along line 526*f*.

Figure 5G:
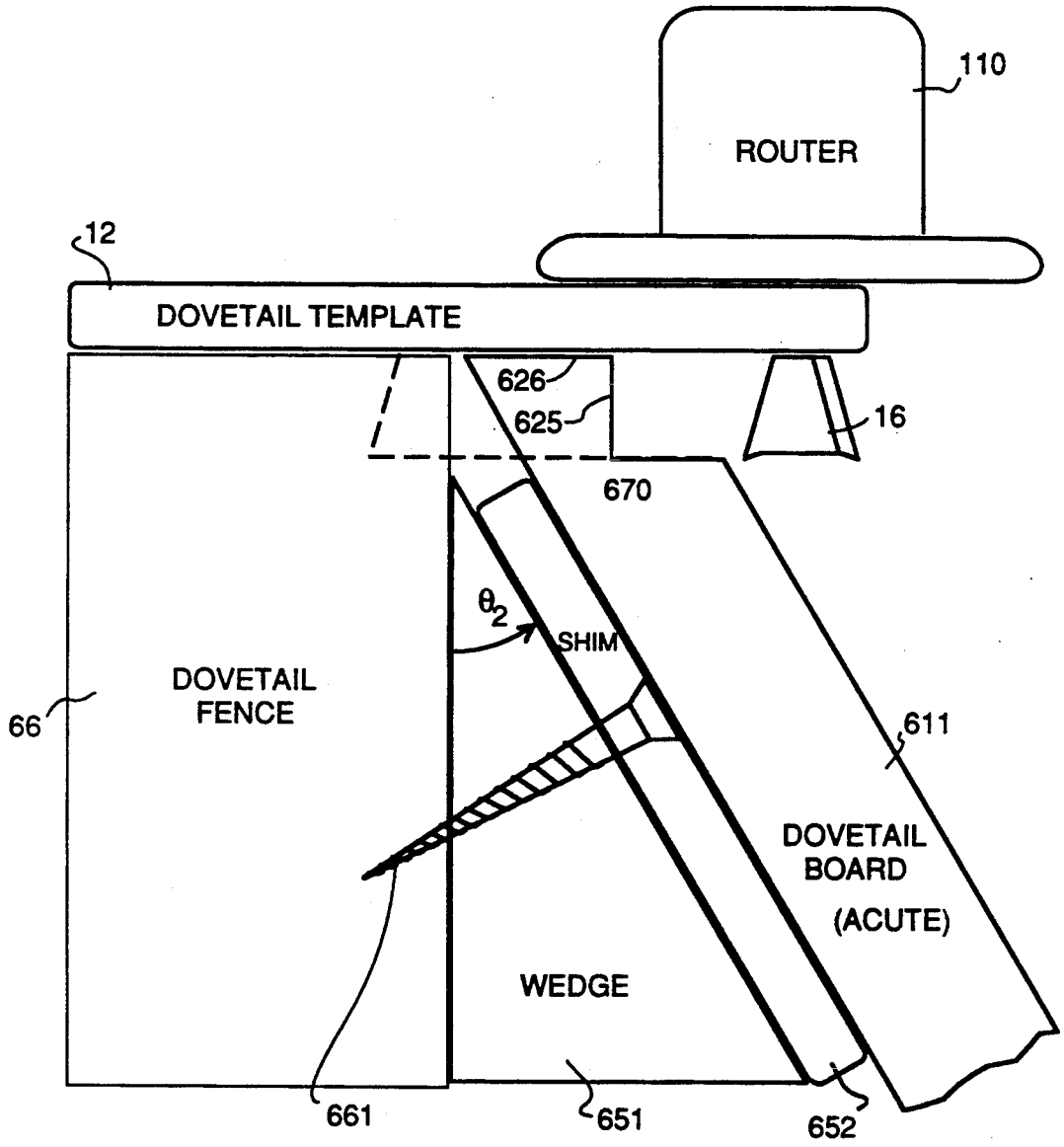
FIG. 5*g* shows a setup for cutting a dovetail board to receive a pin board at an acute angle.

FIGS. 5*c* and 5*g* show the structure of an acute angle joint and a setup for forming such a joint.

As shown in FIG. 5*c*, dovetail board 611 has been cut at surface 626 extending from a corner of dovetail board 611 at an angle $\theta_2$ which is the number of degrees less than 90° for which the desired acute angle will be formed. At the point where line 626 contacts the opposite surface of dovetail board 611, surface 625 is cut 90° from this first surface 626. Surface 625 extends an amount equal to the thickness of pin board 615 into dovetail board 611. This cut may be made before or after dovetail cuts are made in dovetail board 611. As shown in FIG. 5*g*, wedge 651 is placed against dovetail fence 66, and held in place by some means, for example screw 661 shown in FIG. 5*g*. A shim 652 may be used in combination with wedge 651 in order that the same screw hole for wedge 651 can be used for forming both acute and obtuse cuts. Alternatively wedge 651 may be placed with its apex abutting dovetail template 12. With this setup, dovetail board 611 in which surface 626 has been cut fits against both wedge 651 or its shim 652 and template 12. As shown in FIG. 5*g*, router 110 with bit 16 makes a cut along dotted line 670. After this cut is made and the board removed, pin board 615 can slide into dovetail board 611 at the desired acute angle.

Figure 6A:
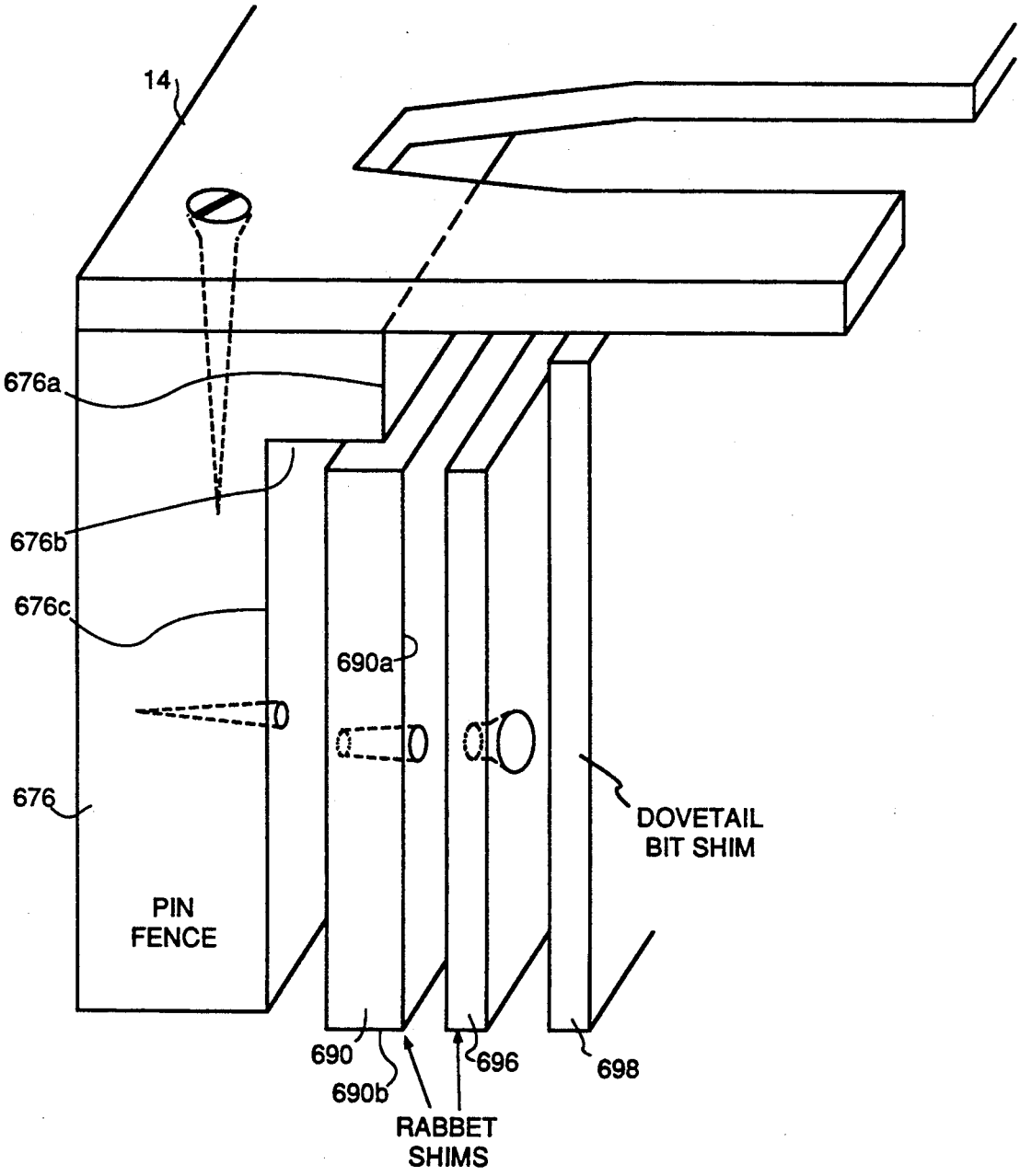
FIG. 6*a* shows a rabbeted pin fence for accommodating pin board stock thicker than the length of a dovetail bit to be used and shims for adjusting the fence to correspond to a thickness of pin board stock to be used.

According to another feature of this invention, it is possible to make pin cuts in boards of thickness greater than the length of dovetail bit 16. As shown in FIG. 6*a*, pin fence 676 is rabbeted at surface 676*c* to step away from surface 676*a*. Surface 676*a* is installed against pin template 14 along a scribed line such as line 419 in FIG. 4*b*. A set of shims such as shims 690, 696, and 698 are provided for adjusting the setup to accommodate pin boards of thickness greater than the length of the dovetail bit and to accommodate dovetail bits of diameter smaller than the maximum diameter of dovetail bit 16 for which the scribed line has been marked. Rabbet shim 690 is specifically provided such that its thickness in the dimension of side 690*b* is equal to the depth of cut represented at side 676*b* of pin fence 676. When rabbet shim 690 is screwed into pin fence 676 the resulting surface 690*a* of rabbet shim 690 is flush with surface 676*a* of pin fence 676.

Also shown in FIG. 6*a* is a thinner rabbet shim 696 which can allow for cutting a pin board thicker than the length of dovetail bit 16 but thinner than the maximum thickness for which the rabbet surface 676*c* of pin fence 676 has been prepared. Obviously a plurality of shim thicknesses can be provided for use with board thicknesses desired.

In addition, dovetail bit shim 698 is also provided for attaching to the surface of rabbet shim 690, or in another embodiment attaching to the surface of a non-rabbeted pin fence. Dovetail bit shim 698 allows the user to position the pin board separated away from pin fence surface 676*a*. Such a shim bit is desired when a smaller dovetail bit will be used for cutting a thinner dovetail board.

Figure 6B:
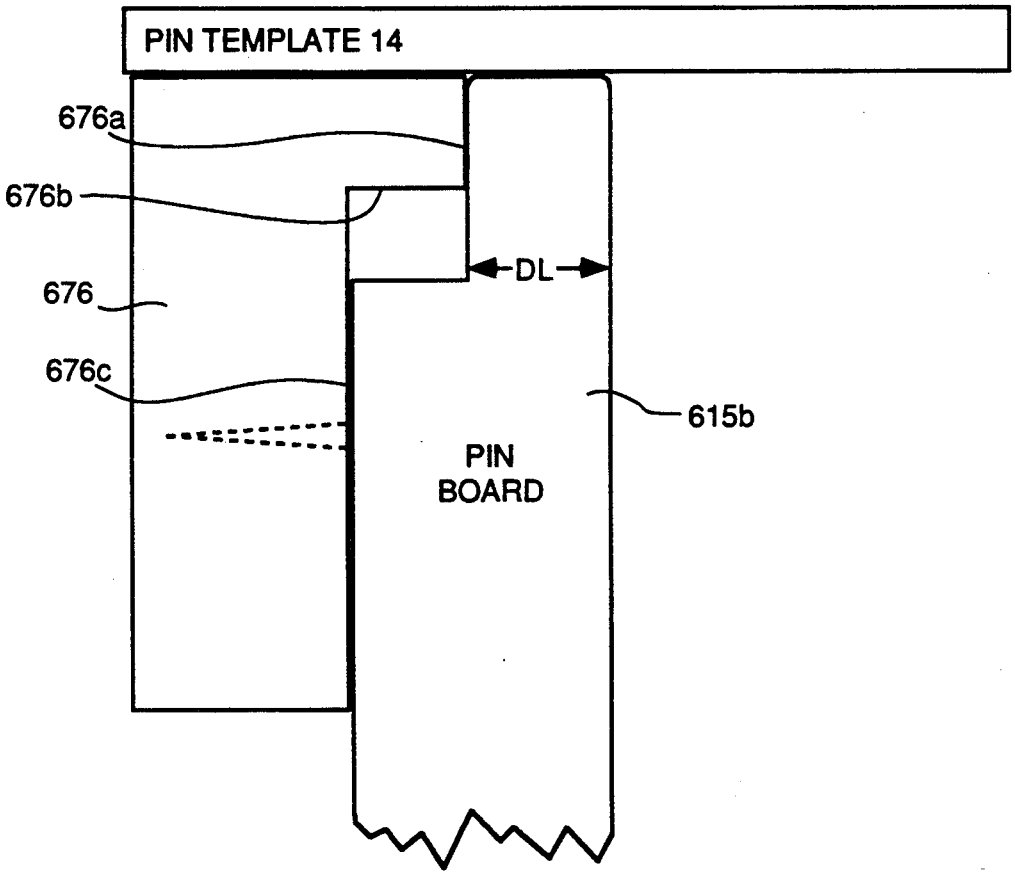
FIG. 6*b* shows a pin fence and rabbeted pin board setup for cutting pins.

As shown in FIG. 6*b*, pin board 615*b* has been rabbeted to a depth equal to distance 676*b* and placed against pin fence 676. The corresponding rabbeted portions of pin board 615*b* and pin fence 676 allow pin board 615*b* to be supported against both pin fence surface 676*a* and pin fence surface 676*c*. Pin board 615*b* has been rabbeted to leave an end of thickness DL equal to the depth of the dovetail socket cut in the corresponding dovetail board.

Figure 6C:
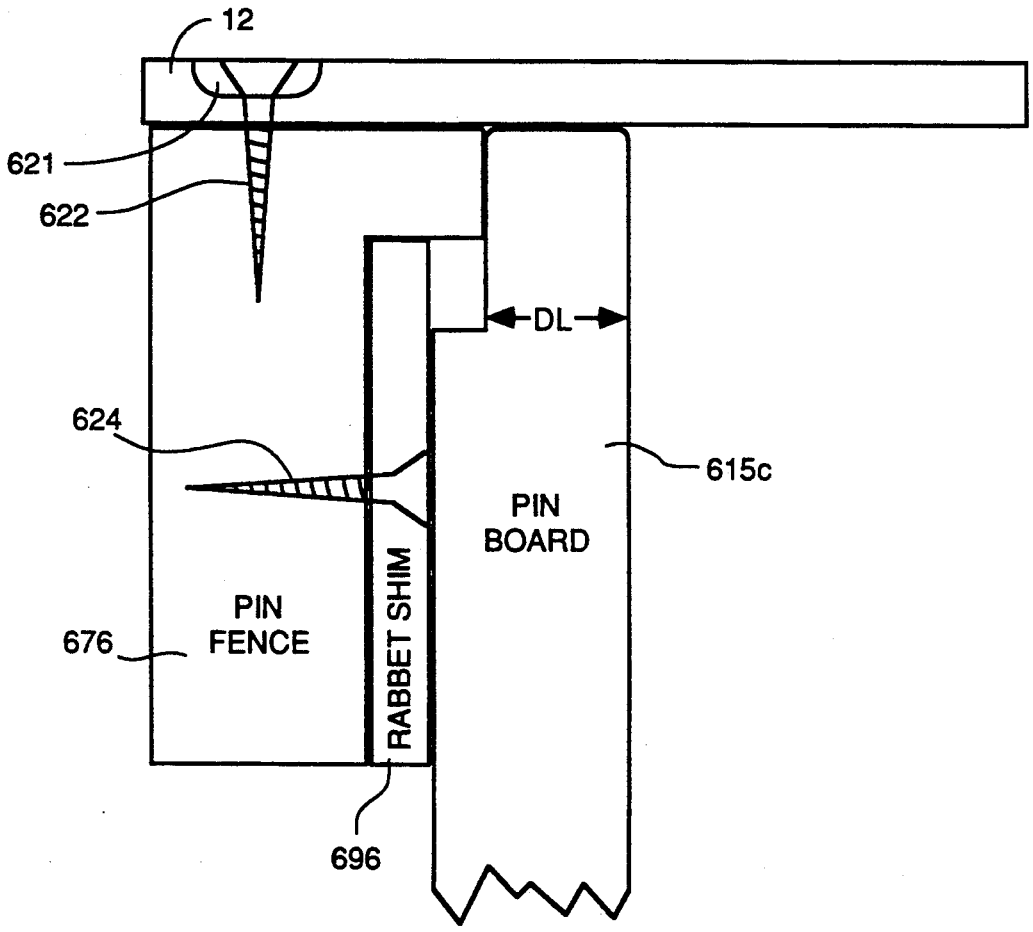
FIG. 6*c* shows a pin fence with a rabbet shim in combination with a pin board setup for cutting pin joints.

As shown in FIG. 6*c*, it is possible to adjust the setup of pin fence 676 and pin template 12 for a less thick pin board 615*c*, by doing nothing more than attaching rabbet shim 696 to pin fence 676. No adjustment of screw 622 with respect to adjusting screw hole 621 is necessary. The positioning of rabbet shim 696 with respect to pin fence 676 is not critical. Therefore the location and positioning of screw 624 is not critical. Further, screw 624 may be removed and replaced quickly.

Figure 6D:
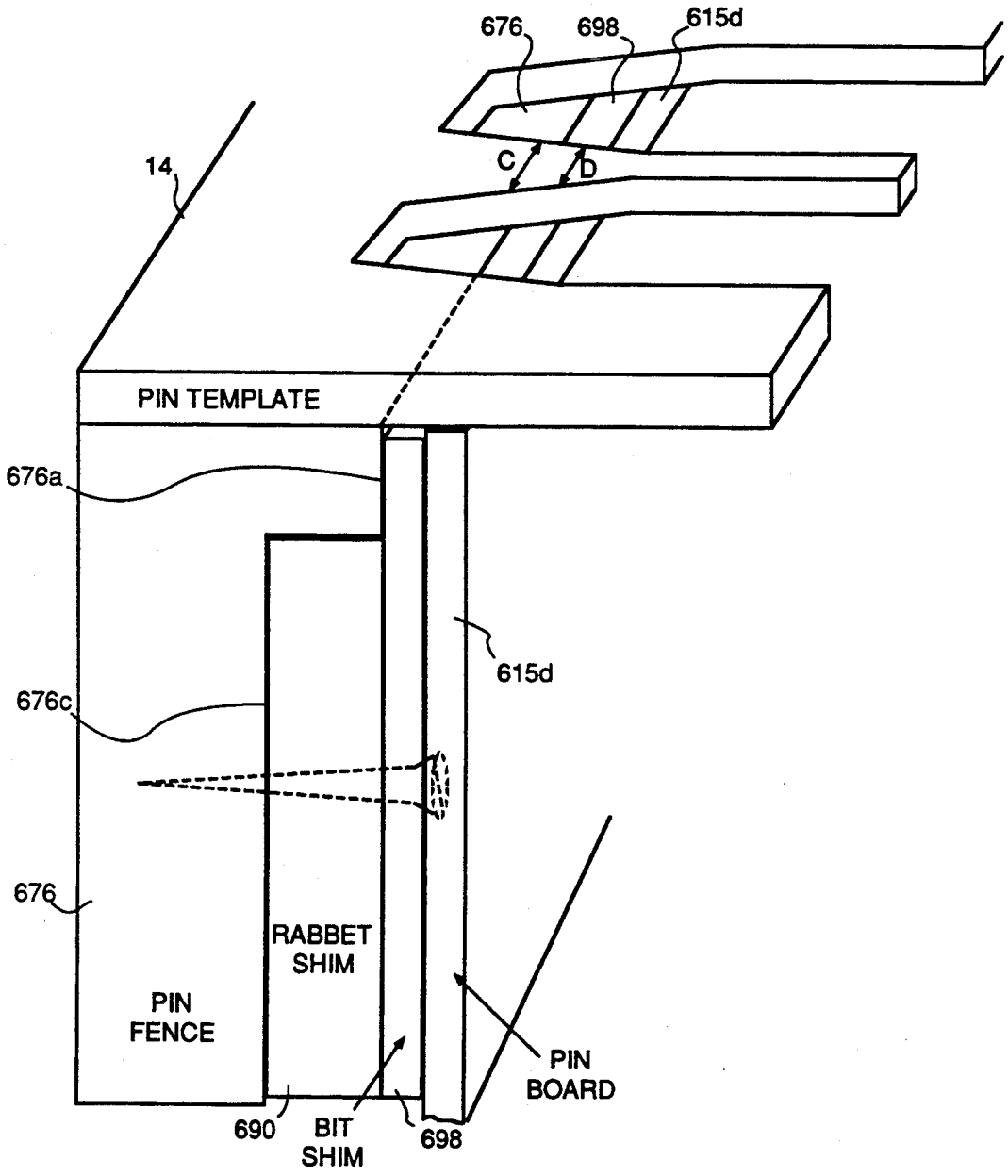
FIG. 6*d* shows the pin fence with both a rabbet shim and a bit shim for holding a pin board when a smaller dovetail bit will be used for cutting a dovetail board into which the pin board shown will be inserted.

FIG. 6*d* shows a setup for performing finer pin cuts on thinner pieces of wood for which smaller dovetail bits and pin bits are preferred. It is possible to make cuts in such thinner pieces of wood using the smaller bits without any change in templates or the adjustment between template 14 and fence 676. As shown in FIG. 6*d*, a bit shim 698 is attached to rabbet shim 690 and pin fence 676. With bit shim 698 in place, pin board 615*d* is held away from fence 676. In this held-away position a separation D between adjacent cuts in pin board 615*d* matches a lower diameter of a smaller dovetail bit (not shown) for which this setup is intended.

Figure 7A:
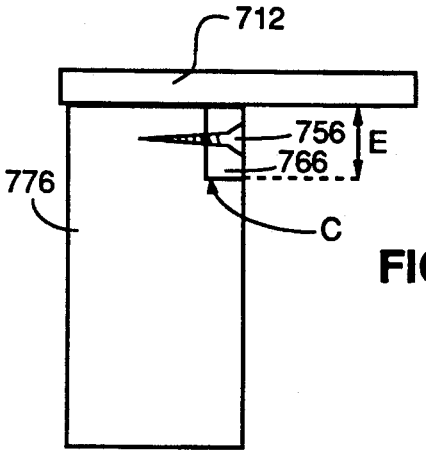
FIGS. 7*a*–7*c* show three fence embodiments which include a replaceable wear strip.
Figure 7B:
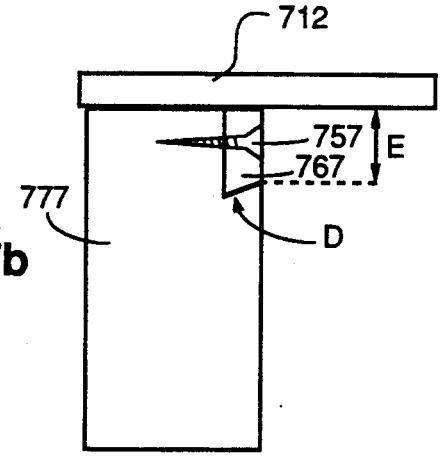
Figure 7C:
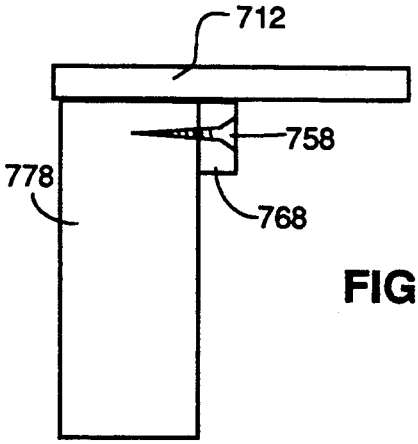

FIGS. 7*a*–7*c* show three fence embodiments which include a replaceable wear strip. Such a feature is valuable when it is desirable to make many pieces having identical measurements and therefore desirable not to change the positioning of the fence with respect to the template. In such situations, over time, the fence can become worn, especially near the corner where the fence joins the template and the router bit is repeatedly cutting adjacent to the fence, and the fence is clipped or damaged or cut away. After such wear, the fence no longer provides good support behind the workpiece and less effectively prevents tearing or chipping of the workpiece. As shown in FIG. 7*a*, fence 776 may be initially built with a rabbet cut C along its entire length at the top edge 776*a* where router cuts will be made. A fence wear strip 766 is built having thickness equal to the rabbet cut and attached to the fence to fill the rabbet cut C. It may be desirable to build several identical wear strips at one time. As shown in FIG. 7*a*, screws 756 are preferably used for attachment, though other removable means such as nails or clamps may also be used. As shown in FIG. 7*a*, rabbet C and wear strip 766 may be cut with a rectangular cross section. Alternatively, as shown in FIG. 7*b*, rabbet D in fence 777 and wear strip 767 may be cut in an acute angle, which may provide a more secure and stable seating of wear strip 767 in fence 777. The width E of wear strip 767 should exceed the maximum depth of cut of router bits 16 and 18 (or maximum material thickness to be cut for making dovetail joints).

The wear strip feature may be used either alone or in conjunction with a rabbet shim such as shown in FIGS. 6*a*–6*d*. Alternatively, FIG. 7*c* shows an embodiment in which the wear strip 768 is attached flush to fence 778. This embodiment is especially appropriate for use with setups such as shown in FIGS. 6*a*–6*d*. Wear strips 768 may be selected to have a thickness which cooperates with the shims shown in FIGS. 6*a*–6*d*.

Figure 2D:
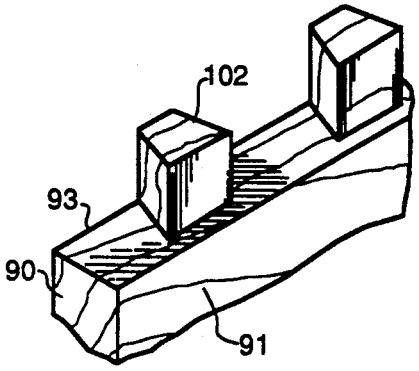
FIG. 2d (PRIOR ART)
FIGS. 2*a* through 2*f* show a set of templates and bits for making dovetail joints in accordance with U.S. Pat. No. 4,168,730.
Figure 2E:
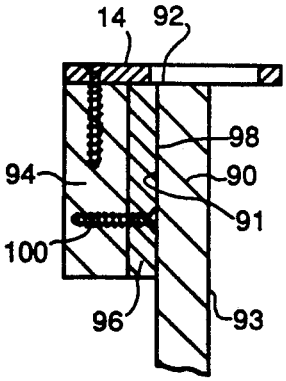
FIG. 2e (PRIOR ART)
Figure 2F:
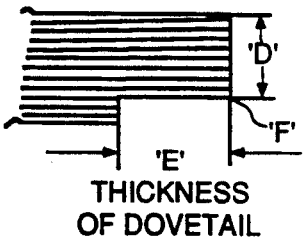
FIG. 2f (PRIOR ART)
Figure 3A:
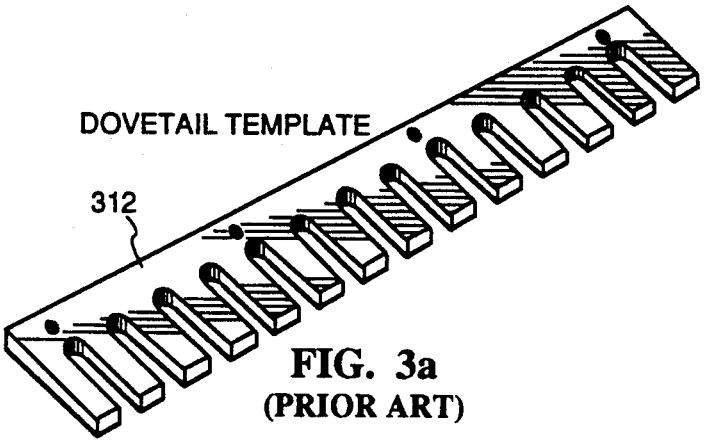
FIG. 3a (PRIOR ART)
FIGS. 3*a* through 3*d* show a set of dovetail and pin template and dovetail and pin bits according to a variation on the above patent.
Figure 3B:
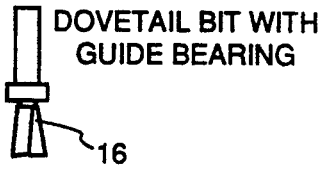
FIG. 3b (PRIOR ART)
Figure 3C:
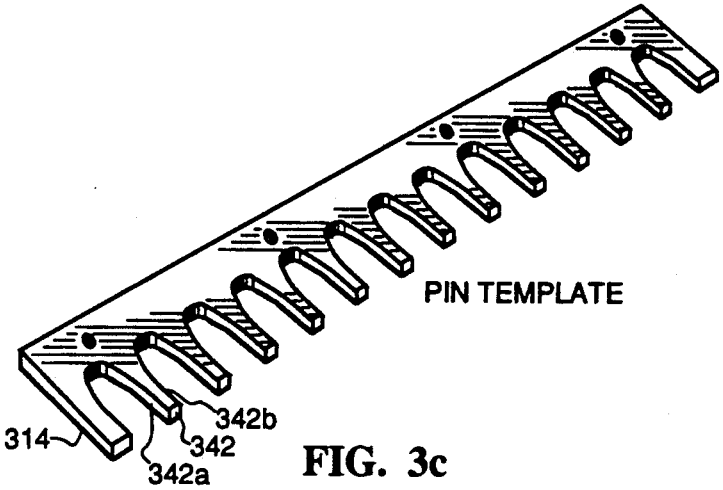
FIG. 3c (PRIOR ART)
Figure 3D:
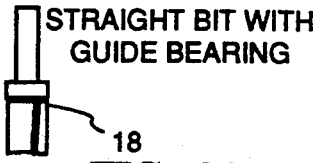
FIG. 3d (PRIOR ART)
Figures 2A, 2B, 2C, 2G, 2H:
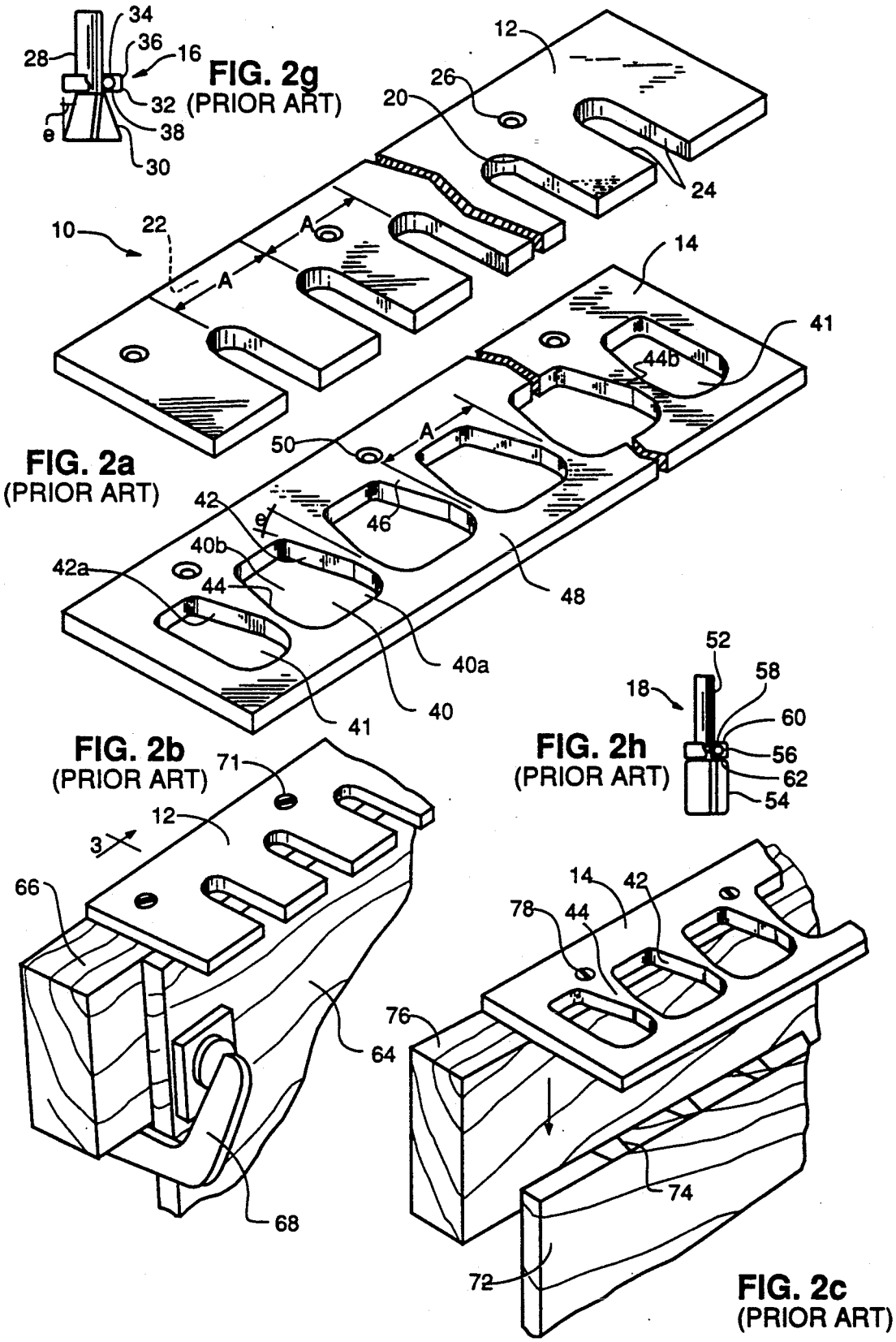
FIG. 2g (PRIOR ART)
FIG. 2a (PRIOR ART)
FIG. 2b (PRIOR ART)
FIG. 2h (PRIOR ART)
FIG. 2c (PRIOR ART)
Figure 8A:
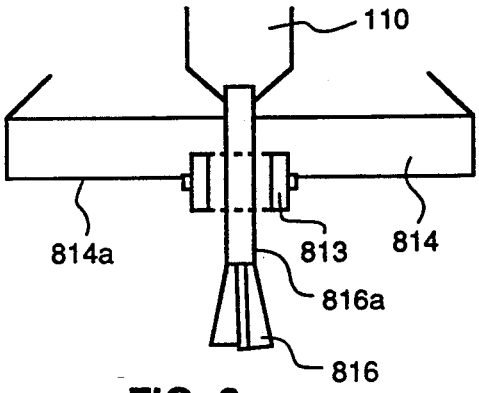
FIGS. 8*a*–8*d* show router bit and guide bushing combinations used for making dovetail cuts without need for router bits having a shank bearing such as shown in FIGS. 3*b* and 3*d*.
Figure 8B:
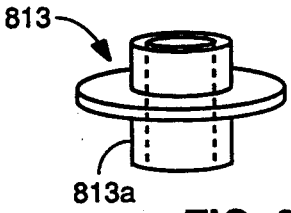

As shown in FIGS. 8*a*–8*e*, it is possible to use guide bushings rather than the special router bits shown in FIGS. 3*b* and 3*d* to guide the router in making cuts. While use of a guide bushing is not as accurate as the use of bearing-guided router bits, and produces greater wear on the templates, it avoids the need for special router bits. A guide bushing 813 as shown in FIGS. 8*a* and 8*b* is inserted into the base 814 of router 110. The rubbing surface 813*a* of guide bushing 813 extends below the bottom surface 814*a* of router base 814. A standard bit shank such as shank 816*a* for either a dovetail bit 816 or a pin bit 818 (see FIG. 8*c*) extends through an opening in guide bushing 813.

For the dovetail bit, the outside diameter of the rubbing surface 813*a* may equal the width of the dovetail template slot. Alternatively, the diameter may be smaller, thereby resulting in wider dovetail sockets.

For the pin bit, the diameter of rubbing surface 813*a* should preferably be equal to but may be greater than the diameter of its corresponding pin bit. If the diameter of guide bushing 823 (see FIG. 8*d*) (or for that matter, of a shank-mounted guide bearing) exceeds the diameter of the pin bit 828, then pin template 814 will not show exactly what will be cut. Instead, as shown in FIG. 8*e*, the pin cuts 815 will be smaller than indicated by pin template 814, leaving wider pins than would be suggested by pin template 814. Though it is more intuitive to set up the apparatus if guide bearings have the same diameter as the pin bits to be guided, it is possible to accurately achieve as desired result using guide bushings (or bearings) larger than the pin bit diameter, a shown in FIGS. 8*d* and 8*e*. Of course, the pin template 814 must be adjusted with respect to the pin fence 866 (see FIG. 8*e*) to achieve cuts of the proper dimension, and some additional experimentation may be necessary before a satisfactory fit is achieved.

Figure 4A:
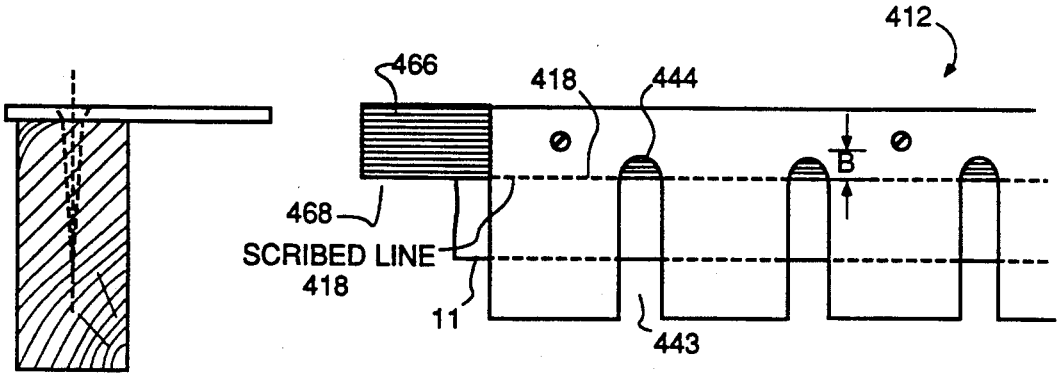
FIG. 4a (PRIOR ART)
FIGS. 4*a* and 4*b* show a set of dovetail and pin templates in which a scribed line indicates a preferred location for dovetail and pin fences.
Figure 4B:
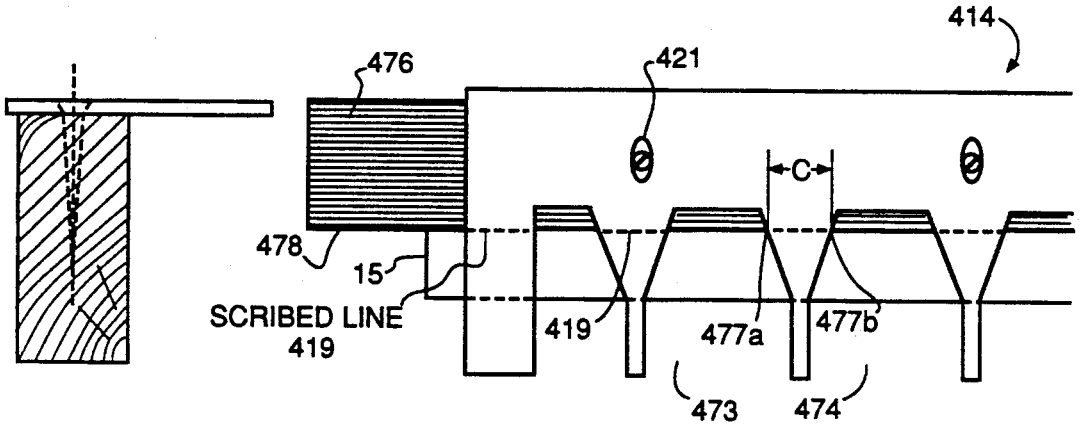
FIG. 4b (PRIOR ART)
Figure 4C:
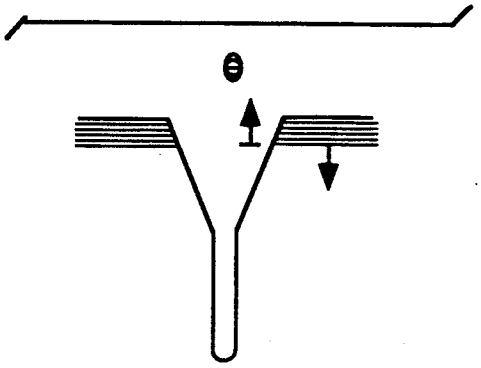
FIG. 4c (PRIOR ART)
FIG. 4*c* shows a pin template with an elongated screw hole for adjusting the position of the pin template with respect to the pin fence.
Figure 9A:
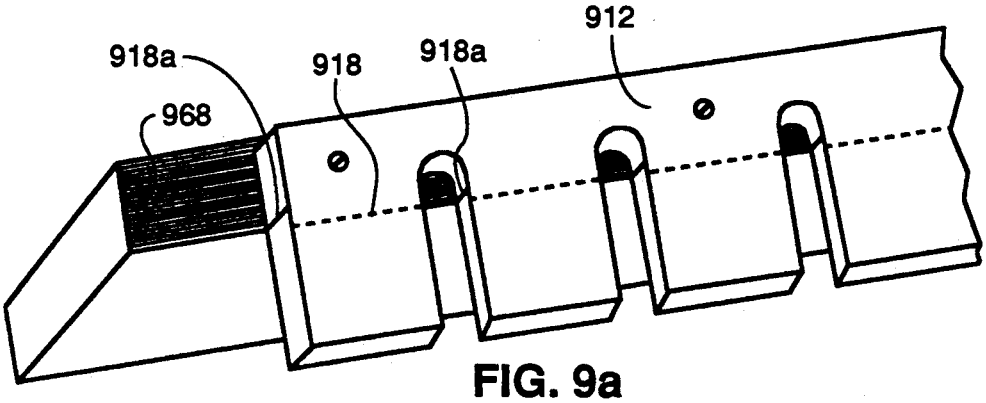
FIGS. 9*a l and 9b* show an improved placement of scribed lines for guiding the attachment of the fence to the corresponding template.
Figure 9B:
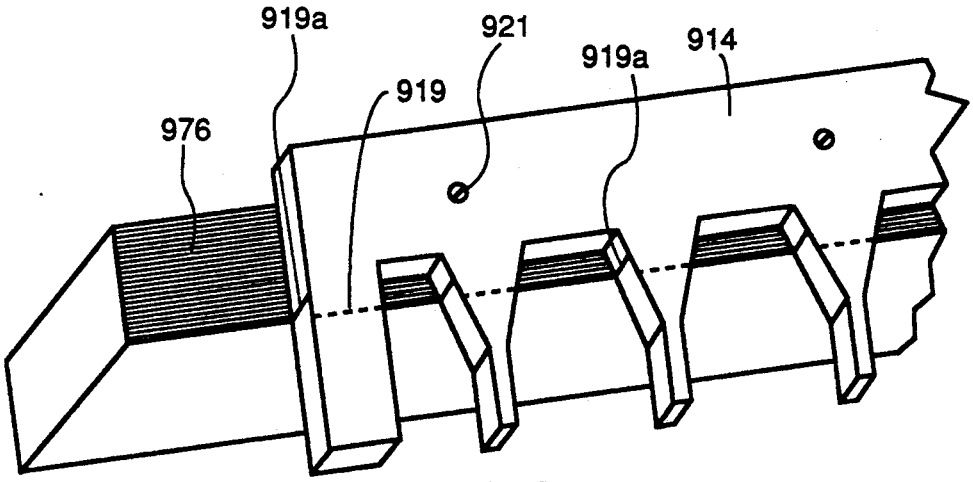

As shown in FIGS. 9*a* and 9*b*, the present invention includes an improvement on the placement of scribed lines as compared to prior art FIGS. 4*a* and 4*b*. Whereas the prior art templates 412 and 414 of FIGS. 4*a* and 4*b* respectively, included scribed lines 418 and 419 on their bottom surfaces for aligning fences 466 and 476 respectively to templates 412 and 414, as shown in FIG. 9*a*, the improvement includes extending scribe lines 918 vertically from the actual surface to which the fence is attached, forming scribe line extensions 918*a*. These extensions 918*a* remain easily visible to the user when fence 968 is in position against template 912. Likewise, as shown in FIG. 9*b*, scribe lines 919 extend vertically from the surface to which fence 976 is attached, forming scribe line extensions 919*a*, which also remain easily visible to the user when fence 976 is in position against template 914. These vertical extensions of the scribe lines further assist the user in properly registering the fence against the template when making the attachment. This is especially beneficial for positioning pin template 914 shown in FIG. 9*b*, since positioning of template 914 against fence 976 is essential to achieving proper pin size and thus proper fit.

Figure 10A:
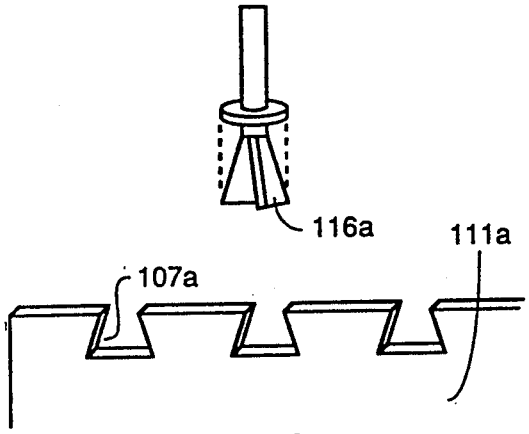
FIGS. 10*a* and 10*b* show dovetail cuts made using different sizes of dovetail bits and the same dovetail template.
Figure 10B:
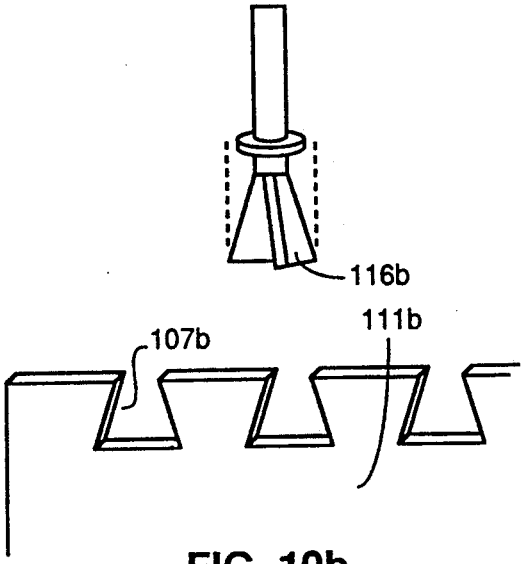
Figure 10C:
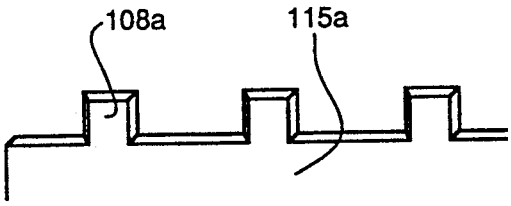
FIGS. 10*c* and 10*d* show pin cuts made using different pin template setups for mating with FIGS. 10*a* and 10*b* respectively.
Figure 10D:
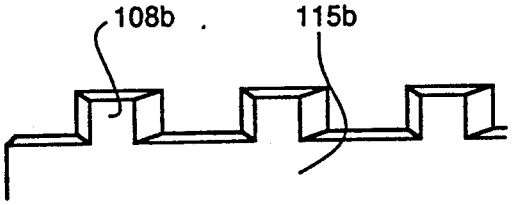

FIGS. 10*a*–10*d* show sets of dovetail boards (FIGS. 10 and 10*b*) and pin boards (FIGS. 10*c* and 10*d*) out using the same set of dovetail and pin templates, for example the set in FIGS. 9*a* and 9*b*. The spacing between adjacent dovetail sockets or pins is the same for the six FIGS. 9*a*, 9*b* and 10*a*–10*d*. The dovetail sockets 107*a* shown in FIG. 10*a* were cut into thin dovetail board 111*a* using small dovetail bit 116*a*. Dovetail sockets 107*b* of FIG. 10*b* were cut into thicker dovetail board 111*b* using larger dovetail bit 116*b*. The same dovetail template and fence combination was used for both boards. For cutting thinner pin board 115*a* of FIG. 10*c* and thicker pin board 115*b* of FIG. 10*d*, the same pin fence-template and pin bit may be used. The larger size of pins 108*b*, which is selected to match the size of sockets 107*b* of FIG. 10*b*, is achieved by placing pin board 115*b* directly against the pin fence, for example fence 976 of FIG. 9*b*, for cutting away the waste. The smaller size of pins 108*a*, selected to mate with dovetail sockets 107*a* of FIG. 10*a*, is achieved by placing a shim between pin board 115*b* and the pin fence, for example fence 976 of FIG. 9*b*. The height of pins 108*a* and 108*b* is preferably selected to match the thickness of corresponding dovetail boards 111*a* and 111*b*, though a greater height may be cut and used for a decorative effect in the finished product or planed away after assembly. Note that the only change in setup for generating the four cut boards of FIGS. 10*a*–10*d* is placement of a shim against the pin fence for cutting pins 108*a*. No substitution of templates is needed and no movement of pin or dovetail fence with respect to the corresponding template is necessary.

It is further possible using the dovetail joint structure described above to make box joints rather than dovetail joints. For such joints, only the pin bit such as shown in FIG. 3*d* and the dovetail setup such as shown in FIG. 9*a* are needed. In the special case in which fingers of both boards to be joined are of a width half the separation between centers of adjacent dovetail slots, the first and second boards to be joined may be cut together. The box joint cuts are made by placing the two boards together but offset by the amount of the finger width, and clamping the two boards against the dovetail fence, then cut, using not a dovetail bit but the pin bit such as shown in FIG. 3*d*. A pin bit and guide (bushing or bearing) combination which produce fingers of the proper width when guided by the dovetail template are used. If the guide bushing or bearing has a diameter equal to the width of the dovetail slot, then the pin bit must have a diameter equal to the finger width. If the guide bushing or bearing has a diameter smaller than the width of the dovetail slot, then the pin bit should have a diameter correspondingly smaller. In this case, more than one pass of the pin bit through each dovetail slot will be needed to remove the necessary waste.

In the more general case in which the fingers of a first piece of stock are to be smaller and fingers of a second piece of stock are to be larger, the two boards are cut separately. The diameter of the pin bit must of course be no larger than the width of the smaller set of fingers. The first piece of stock is placed against the dovetail setup such as shown in FIG. 9*a* and cut using a pin bit such as shown in FIG. 3*d*. After making this cut in the first piece of stock, the cut lines are marked on the second piece of stock so that waste may be removed from the second piece of stock to match the first piece.

Figure 8C:
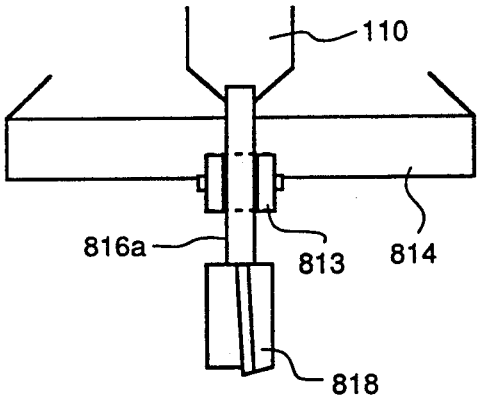
Figure 8D:
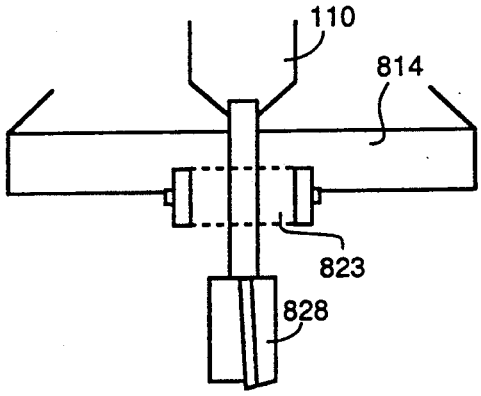
Figure 8E:
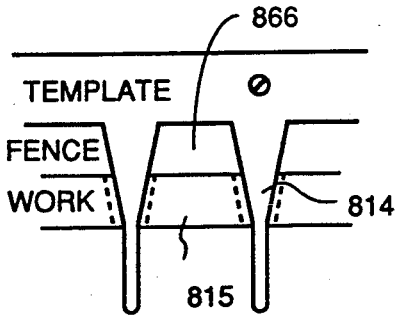

It is preferable that the bearing of the pin bit (or alternatively the collar of a guide bushing such as shown in FIG. 8*c*) have the same diameter as the pin bit so that the cut made in the stock will line up with the dovetail template, and the scribe lines made on the second piece of stock can simply be aligned with slots of the dovetail template. If the pin bit and bearing are selected to make a cut aligned with the template, the second piece of stock is simply aligned at the marks with the dovetail template and the pin bit used for removing the waste in the second piece of stock. If a pin bit such as shown in FIG. 8*d* is chosen, the cut will not align with the template. In this case, the stock must be moved with respect to the template such that the side of the pin bit aligns with the scribed marks.

The resultant pair of boards can then be fitted together to make joints, and may be joined either at a 90 degree angle to make a box joint, or in a straight line to form a longer board. This method for making box joints can be varied to make obtuse or acute angle joints using the methods described above for dovetail joints.

In light of the above description, other embodiments of the present invention will become obvious to those skilled in the art. Such other embodiments are intended to fall within the scope of the present invention.

What is claimed is:

1. Using a dovetail template fixedly joined to a dovetail fence, a method for cutting dovetails in an end of a dovetail board which is to be joined to a pin board at an intended angle other than a right angle comprising:

constructing said dovetail fence to have a surface forming an apex angle with respect to said dovetail template equal to the amount different from 90 degrees of said intended angle;

aligning said dovetail board with said surface such that said end contacts said dovetail template; and using a dovetail bit to form dovetail cuts in said dovetail board as guided by said dovetail template.

2. Method fur cutting dovetails as in claim 1 in which said step of constructing said dovetail fence to have a surface comprises attaching a wedge shaped shim to said dovetail fence, said dovetail fence having a rectangular cross section and said wedge shaped shim having an apex angle complementary to said intended angle.

3. Method for cutting dovetails as in claim 1 in which said step of constructing said dovetail fence to have a surface comprises forming said dovetail fence to have a surface facing said dovetail board which extends downward from said dovetail template at said angle with respect to said dovetail template equal to the amount different from 90 degrees of said intended angle.

4. Method for cutting dovetails as in claim 1 in which said dovetail board is placed against a shim of constant thickness which is placed against said fence.

5. Method for cutting dovetails as in claim 1 in which said end of said dovetail board is cut at an angle which differs from perpendicular to said dovetail board by said apex angle.

6. Method for cutting dovetails as in claim 5 in which said dovetail board includes an abutting section extending at 90 degrees from said end, wherein said abutting section will contact a cut surface of a pin board when said dovetail board is mated with said pin board to make a dovetail joint.

7. Method for cutting dovetails as in claim 2 in which said wedge is positioned against said fence and separated from said dovetail template by an amount equal to the length of a cutting surface of a dovetail bit to be used in cutting said dovetail board as measured along the axis of said dovetail bit.

8. Method for cutting dovetails as in claim 2 in which said wedge is positioned against said fence such that said wedge contacts said dovetail template.

9. Method for cutting dovetails as in claim 8 in which said end of said dovetail board is approximately perpendicular to a major surface of said dovetail board when said dovetail board is placed against said dovetail fence and cut.

10. Method for cutting dovetails as in claim 8 in which said end of said dovetail board is cut at an angle to fit flush against said dovetail template when said dovetail board is placed against said dovetail fence for cutting.

11. A method for cutting box joints using structure for cutting dovetail joints in which said structure includes a dovetail fence attached to a dovetail template and includes a pin bit, said method comprising:

holding stock in which said box joints are to be formed against said dovetail fence abutting said dovetail template;

cutting a first piece of said stock with said pin bit;

marking a second piece of said stock to match cuts made in said first piece of stock;

aligning marks on said second piece of said stock with an edge of said pin bit when said pin bit is placed against said dovetail template; and cutting said second piece of stock as aligned against said dovetail template.

12. A method as in claim 11 in which said step of aligning marks on said second piece of stock with an edge of said pin bit when said pin bit is placed against said dovetail template comprises aligning marks on said second piece of stock with said dovetail template.

13. A method for cutting boards having fingers of equal width for making box joints, said method using structure for cutting dovetail joints in which said structure includes a dovetail fence attached to a dovetail template and includes a pin bit, said method comprising:

stacking said boards such that edges in which cuts to be made are aligned and sides of said boards are offset by an amount equal to the width of said fingers;

holding said boards against said dovetail fence abutting said dovetail template; and cutting said boards as guided by said dovetail template.

* * * * *